United States Patent [19]

Field

[11] Patent Number: 4,552,272

[45] Date of Patent: Nov. 12, 1985

[54] DISPLAY BIN

[76] Inventor: Frank P. Field, 854 Napoli Dr., Pacific Palisades, Calif. 90272

[21] Appl. No.: 599,193

[22] Filed: Apr. 11, 1984

[51] Int. Cl.[4] ..... A47F 5/08

[52] U.S. Cl. ..... 211/88; 108/61; 220/22.3; 211/184; 248/242; 248/222.2

[58] Field of Search ..... 211/184, 88, 90, 187, 211/193, 490; 220/22.3; 206/561; 108/111, 61; 248/243, 242, 222.2, 220.2, 220.3; 411/508, 509, 510

[56] References Cited

U.S. PATENT DOCUMENTS

| | | | |
|---|---|---|---|
| 1,103,444 | 7/1914 | Standfest | 411/451 |
| 2,900,086 | 8/1959 | Levy | 211/90 |
| 3,097,746 | 7/1963 | Handler et al. | 211/126 |
| 3,172,540 | 3/1965 | Berge | 211/90 X |
| 3,235,218 | 2/1966 | Graham | 248/220.3 |
| 3,269,558 | 8/1966 | Hess | 211/184 |
| 3,501,019 | 3/1970 | Armstrong et al. | 108/61 X |
| 3,905,484 | 9/1975 | Dean et al. | 211/184 |
| 4,450,970 | 5/1984 | Shepherd | 248/222.2 X |

FOREIGN PATENT DOCUMENTS

| | | | |
|---|---|---|---|
| 1106122 | 5/1958 | Fed. Rep. of Germany | 411/509 |
| 939044 | 10/1963 | United Kingdom | 248/242 |

*Primary Examiner*—Robert W. Gibson, Jr.

*Attorney, Agent, or Firm*—Hubbard, Stetina & Brunda

[57] ABSTRACT

This invention relates to display apparatus for forming bins to display merchandise or to store objects. A display bin includes means for mounting dividers while maintaining the front panel clear of obstructions. The invention includes brackets attached to the bin for mounting the bin to either vertically slotted rails or horizontally slotted walls. The brackets preferably permit adjustment of the angular orientation of the bin relative to the rails or walls.

9 Claims, 9 Drawing Figures

DISPLAY BIN

BACKGROUND OF THE INVENTION

This invention relates to apparatus for displaying merchandise for sale in retail and commercial establishments or for storing objects.

As is well known, a variety of commercial marketing display systems are currently being utilized in the trade. With competition between establishments becoming increasingly more intense, the importance of aesthetics and utility of such displays has been recognized with such display systems oftentimes providing the critical difference in persuading consumers to purchase displayed products. Previous display devices have typically proven inconvenient to assemble and fail to include convenient means for dividing a display bin into a plurality of bins of selected size with divider means structurally sufficient to remain in place during continual abuse caused by consumers removing articles from the bins. Similarly previous display apparatus have also failed to include convenient means for attaching the display case to both vertically slotted rails and horizontally slotted walls which have recently been introduced into the merchandising trade. Further, most prior art display bins have included various obstructions which have limited a customer's vision through the front panel of the bins and thereby have detracted from the marketing of articles and merchandise contained within the bins.

SUMMARY OF THE INVENTION

This invention specifically overcomes the deficiencies of prior art display devices by providing a display system which includes means for conveniently and securely dividing the bin into a plurality of smaller bins of selected size while maintaining the front panel clear of obstructions. The invention further includes means for mounting the bin to a pair of conventional vertically slotted rails or to a modern horizontally slotted wall structure.

A plurality of closely spaced pairs of parallel projections formed in the rear wall of the bin form slots for holding dividers which may be used to divide the bin into a plurality of smaller bins. Projections extend from edges of the dividers for engagement in orifices in the bottom of the bin. The slots, projections and orifices cooperate to retain the dividers upright and prevent their accidental removal while permitting easy assembly and disassembly.

The mounting bracket permits the bin to be mounted to a wall so that the plane of the bottom of the bin makes a selected angle with respect to the wall.

The mounting bracket may include either a plurality of hooks for engaging vertically slotted rails that may be conveniently mounted to a wall or a pair of retainers that engage the edges of horizontal grooves formed in a wall.

DESCRIPTION OF THE PREFERRED EMBODIMENT

Figure 1:
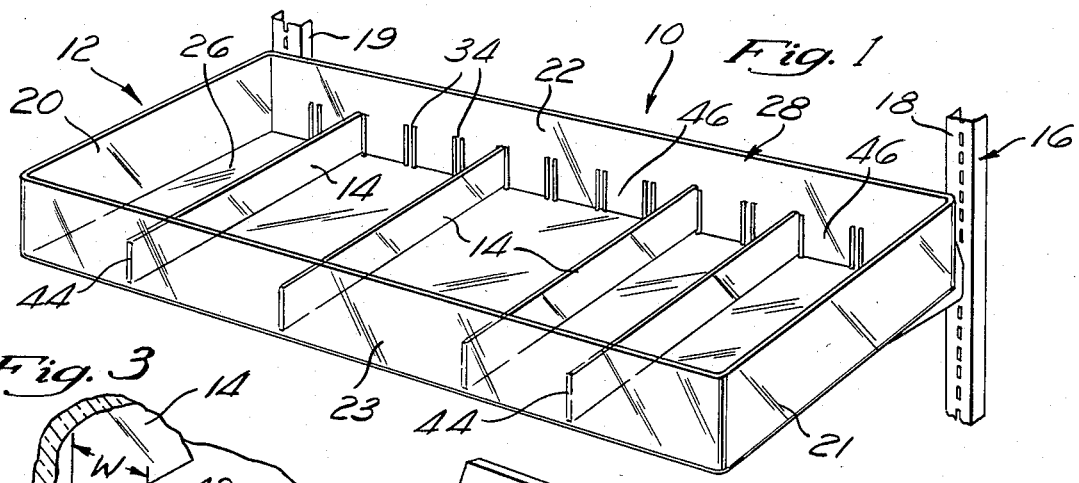
FIG. 1 is a perspective view of the invention showing an improved display bin and dividers for dividing the display bin into smaller bins.

Referring to FIG. 1, a display system 10 includes a bin 12, which includes at least one divider 14, and apparatus 16 for mounting the bin 12 to a pair of rails 18 and 19.

The bin 12 is preferably formed to have a pair of generally rectangular side walls 20 and 21, a rear wall 22, a front wall 23, and a rectangular bottom 26. The walls 20–23 and the bottom 26 enclose a display volume 28. The bin 12 is preferably formed of an injection molded transparent durable material such as polycarbonate, (General Electric sells suitable polycarbonate material under the trademark Lexan); however, other plastic materials may be utilized.

Figure 2:
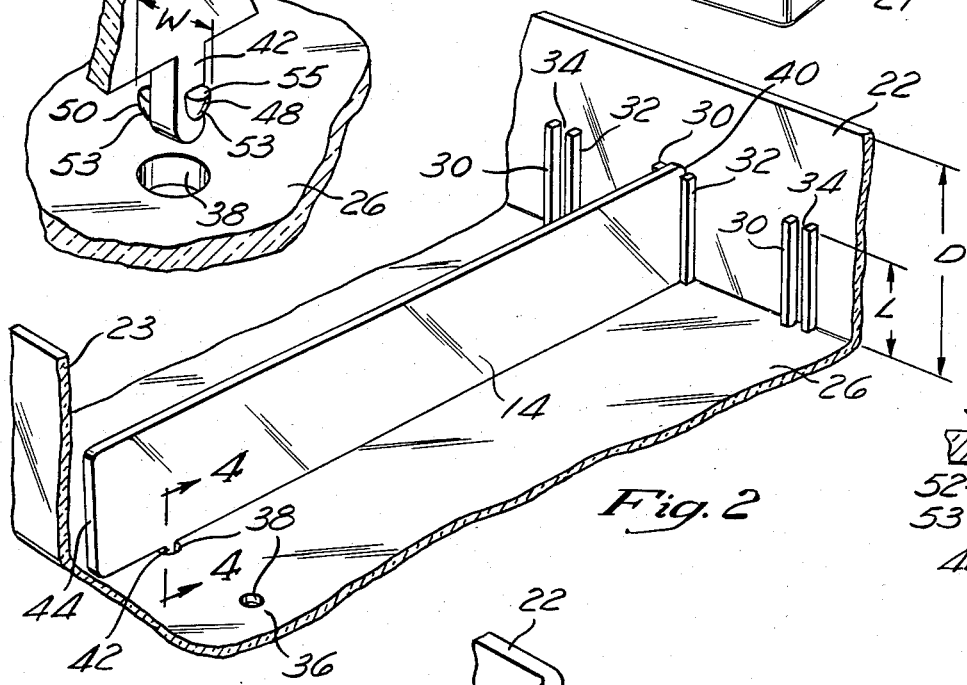
FIG. 2 is a partial perspective view of the interior of the display bin of FIG. 1.

Referring to FIGS. 1 and 2, the rear wall 22 preferably includes a plurality of pairs of parallel, closely spaced projections 30 and 32 extending therefrom. The projections 30 and 32 preferably have lengths such that they extend from locations near the bottom 26 a distance, L, along the rear wall 22 approximately half the depth, D, of the bin 12. The projections 30 and 32 form a slot 34 on the rear wall 22. The slot 34 is preferably perpendicular to the bottom surface 26. The rear wall 22 includes a plurality of such slots 34 arranged to be conveniently equidistantly spaced distance, such as one inch, apart along the length of the wall 22.

The bottom surface 26 includes a row 36 of orifices 38. The row 36 is preferably parallel to the front wall 23. The orifices 38 are preferably arranged in registered alignment with the slots 34 so that center lines extending from the slots 34 parallel to the side walls 20 and 21 intersect the corresponding orifices 38.

Referring to FIGS. 1 and 2, the dividers 14 are formed to have generally elongate rectangular configurations. An end 40 of the divider 14 fits within the slot 34, which retains the divider 14 in perpendicular orientation with the bottom 26 of the bin 12. The divider 14 has a projection 42 which extends into the orifice 38 that corresponds to the slot 34. The projection 42 is near the other end 44 of the divider 14 so that the projection 42, the orifice 38 and the slot 34 cooperate to retain the divider 14 perpendicular to the bottom surface 26 and parallel to the side walls 20 and 21. Other orientations of the divider 14 are possible, but the orientation described above is generally preferred for displaying merchandise for sale in retail stores.

The dividers 14 may be selectively placed in as many of the slots 34 and corresponding orifices 38 as necessary to divide the bin 12 into a plurality of bins 46 having dimensions appropriate for displaying particular items for sale. The front wall 23 is preferably free of any structure that might obstruct a customer's view into the bins 46.

Figure 3:
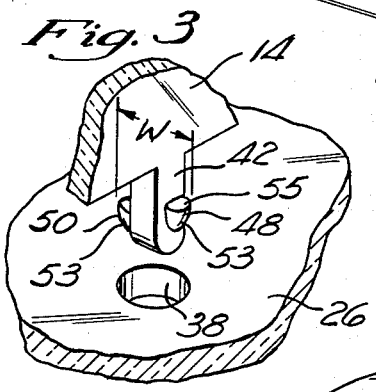
FIG. 3 is a partial perspective view showing means for mounting the dividers of FIG. 1 in the display bin.

Referring to FIG. 3, the projection 42 preferably includes a pair of barbs 48 and 50 extending from opposite sides thereof. The barbs 48 and 50 preferably extend away from the plane of the rectangular dividers 14 and are symmetrically positioned on the projection 42.

Figure 4:
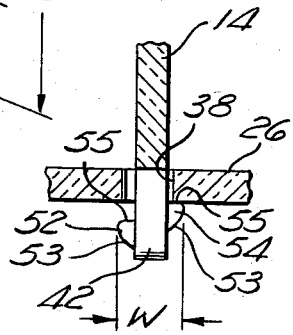
FIG. 4 is a cross sectional view taken along line 4—4 of FIG. 3.

As shown in FIG. 4, the projection 42 may include a pair of barbs 52 and 54 offset along the length of the projection 42 from one another. The projection 42 may be easily engaged in the orifice 38 by first angling the divider 14 relative to the plane of the bottom surface 26 so that the barb 52 extends into the orifice 38 and then rotating the divider 14 into a perpendicular orientation relative to the bottom surface 26 while urging the divider 14 toward the bottom surface 26 to force the barb 54 into the orifice 38. The divider 14 should be sufficiently flexible to permit some twisting thereof about its longitudinal axis to permit rotation of the projection 42 into the orifice 38 while the end 40 is engaged in the slot 34.

It is an important feature of the present invention that once the dividers 14 are mounted within the bin 12, they are structurally sufficient to remain securely in place even upon encountering typical abuse caused by continual removal of articles (not shown) from the bin 12 by consumers. This beneficial result is made possible by sizing the overall width, W, (shown in FIGS. 3 and 4) across the barbs 48 and 50 and 52 and 54 (respectively) to be equal to or slightly greater than the diameter of the orifice 38. Entry of the barbs 48–54 into the orifice 38 is enhanced by the lower most edge or surface 53 being formed in a convex configuration while withdrawl of the barbs 48–54 from the orifice 38 is retarded by the upper most edge 55 of the barbs 48–54 being formed in linear configuration preferably perpendicular or at an acute angle to the axis of the projection 42. As such, upon complete entry of the barbs 48–54 into the orifice 38, a slight snapping action is provided which additionally retards withdrawal of the projection 42 from the orifice 38 except by purposeful manipulation of the divider 14.

Figure 5:
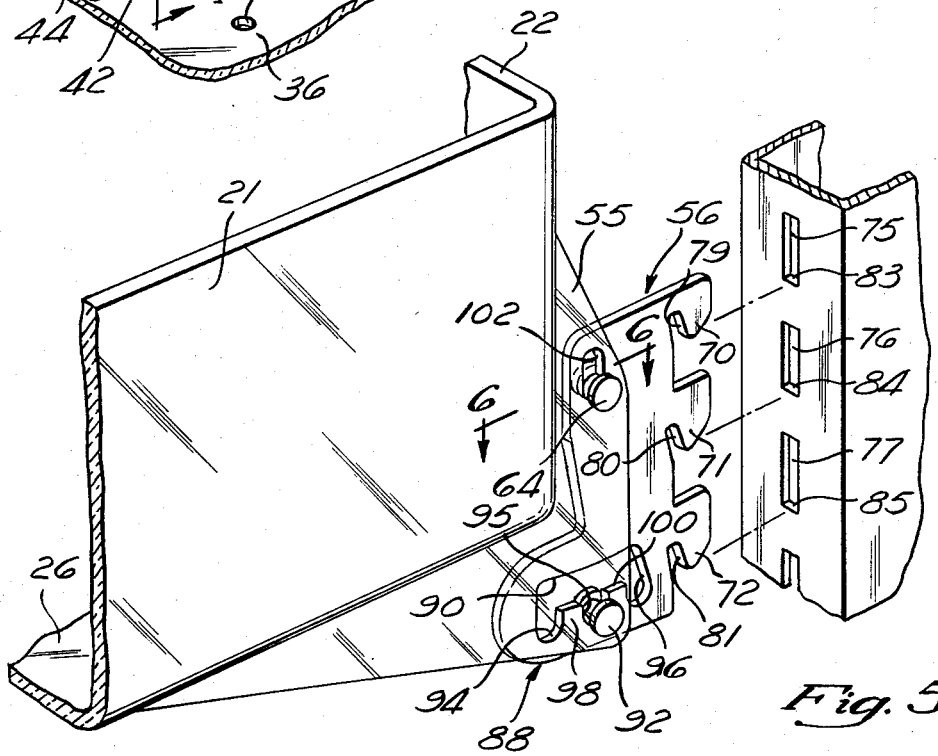
FIG. 5 is a perspective view of apparatus for mounting the display bin of FIG. 1 to a wall.

Referring to FIG. 5, the bin 12 preferably includes a web 55 extending from the juncture of the rear wall 22, the side wall 21 and the bottom 26. A bracket 56 is connected to the web 55 for mounting the bin 12 to the rail 18, which is preferably attached to a wall (not shown). A second web (not shown) similar to the web 55 extends from the juncture of the rear wall 22, the side wall 20 and the floor 26. A bracket (not shown) similar to the bracket 56 is connected to the second web to attach the tray 12 to the rail 19. The bracket 56 is rotatably mounted by any suitable means, such as a rivet 64, to the web 55 near its juncture with the rear wall 22. The rails 18 and 19 preferably include a plurality of vertical slots 66 and 68 and are preferably spaced apart such that the bracket 56 is aligned with the row of slots 66 and the other bracket is aligned with the row of slots 68.

Figure 6:
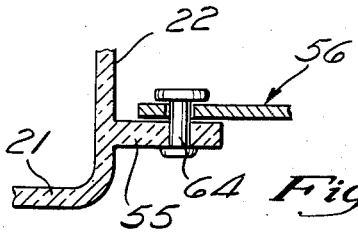
FIG. 6 is a cross sectional view taken along line 6—6 of FIG. 5.

Referring to FIGS. 5 and 6, the bracket 56 includes a plurality of hooks 70–72 for engagement with a corresponding plurality of slots 75–77. The hooks 70–72 and slots 75–77 are dimensioned so that the hooks 70–72 easily penetrate into the slots 75–77. The hooks 70–72 include corresponding recesses 79–81, which permit the hooks 70–72 to interlock with the lower edges 83–85 of the slots 75–77. The hooks 70–72 and slots 75–77 cooperate to support the weight of the bin 12.

The bracket 56 has a lower portion 88 having an opening 90 formed therein. The bracket 56 may support the bin 12 to be either perpendicular to the wall 12 or at other selected angles thereto. A stud 92 extends from the web 55 for selective engagement with one of a plurality of slots 94–96 formed by a pair of inwardly extending teeth 98, 100 formed at the lower edge of the opening 90. The rivet 64 extends into an elongate slot 102 in the bracket 56 to give the bracket 56 a range of linear displacement relative to the web 55. Moving the bin 12 upward relative to the bracket 56 as viewed in FIG. 5 to disengage the stud from the teeth 98 and 100 permits rotation of the bracket 56 relative to the bin 12 to align the stud 92 with a selected one of the slots 94–96. Moving the stud 92 into the selected slot, for example the slot 95, fixes the relative positions of the bin 12 and the bracket 56. The stud 92 may be engaged in a selected slot in the opening 90 both when the hooks 70–73 are engaged or disengaged with the slots 75–77. Having the stud 92 engaged in the slot 95 preferably retains the bin 12 so that the bottom surface 26 is perpendicular to the rails 18 and 19. The slots 94 and 96 permit placement of the bin 12 such that the bottom 26 angles downwardly or upwardly, respectively relative to the horizontal.

The display system 10 may include a plurality of slotted rails 18 and 19 to mount a plurality of bins similar to the bin 12 to the wall to form a display array (not shown).

Figure 7:
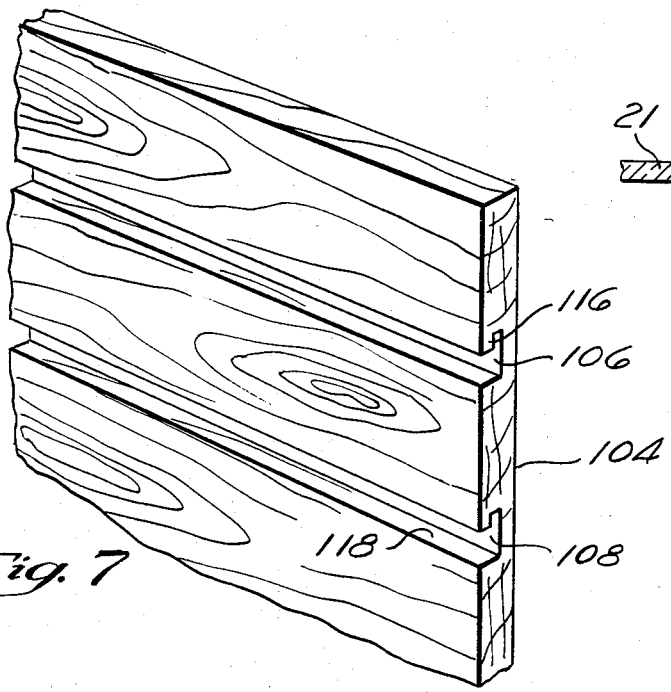
FIG. 7 is a partial perspective view of a wall having horizontal slots for mounting the display bin of FIG. 1.
Figure 9:
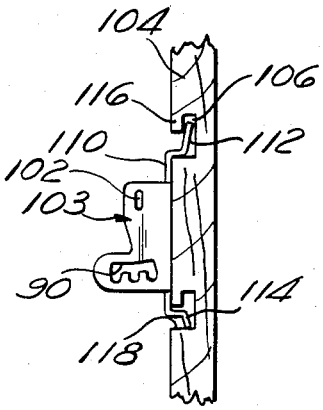
FIG. 9 is a cross sectional view showing the bracket of FIG. 8 mounted in a pair of slots in the wall of FIG. 7.
Figure 8:
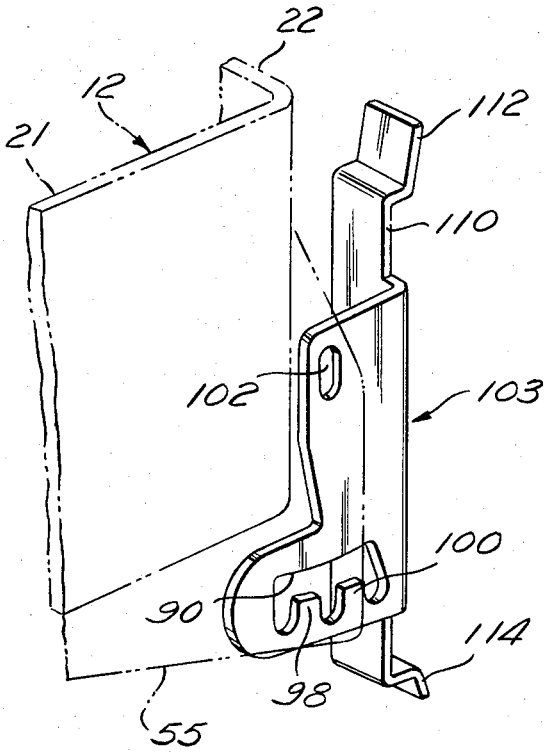
FIG. 8 is a perspective view of a mounting bracket for mounting the display bin of FIG. 1 to the wall of FIG. 7.

Referring to FIGS. 7–9, the display system 10 may also include a bracket 103 for mounting the bin 12 to a wall 104 having parallel rows of slots 106 and 108 therein. The bracket 103 is similar to the bracket 56 except that instead of including the hooks 70–72, the bracket 103 includes a plate 110 having a pair of retainers 112 and 114 extending therefrom for engaging the slots 106 and 108, respectively.

FIG. 9 shows a cross section of the wall 104 and details of the configurations of the slots 106 and 108. The upper slot 106 has a generally L-shaped cross section so that the wall 104 includes an overhang 116. The retainer 112 is inserted into the slot 106 a distance sufficient to permit placement of the retainer 114 in the slot 108, which includes a shoulder portion 118 for engagement with the retainer 114. The shoulder 114 supports the weight of the bracket 103 and attached bin 12. When the retainer 114 rests on the shoulder 118, the overhang 116 restrains the retainer 112 against rotation away from the wall 104.

Both types of brackets 56 and 103 permit rapid attachment and removal of the bin 12 to the walls 60 and 104, respectively, so that unskilled personnel are easily able to assemble an array of the bins 12 for displaying or storing merchandise.

What is claimed is:

1. A system for displaying or storing merchandise or the like, comprising:

a bin including a bottom panel, a pair of side panels, a front panel and a rear panel; the rear panel having at least one panel slot therein, the bottom panel including at least one orifice therein corresponding to each panel slot and spaced apart therefrom;

a divider having a first end adapted for insertion into the panel slot, the divider further including a projection extending therefrom into the orifice when the first end is positioned in the slot so that the panel slot, the projection and the orifice cooperate to retain the divider in a preset position to divide the bin into a plurality of portions while maintaining the front panel free of obstructions; and a pair of barbs extending from said projection to engage the projection in the orifice to retain the divider against accidental removal from the preset position, said pair of barbs being offset from one another along the length of the projection so that the projection may be engaged in the orifice by inserting a first barb into the orifice and then rotating the divider relative to the bottom panel to urge the second barb into the orifice.

2. The system of claim 1 further including means for mounting the bin to a wall.

3. The system of claim 2 wherein the mounting means includes:

a pair of rails mounted to the wall, the rails having a plurality of rail slots therein; and a pair of brackets mounted to the bin, the brackets including means for engaging the rail slots to retain the bin in a predetermined position relative to the wall.

4. The system of claim 3 further including means for adjusting the angular orientation of the bin relative to the wall.

5. The system of claim 4, wherein the adjusting means includes:

means for rotatably mounting the brackets to the side walls of the bin, the mounting means permitting a range of linear displacement of the brackets relative to the side walls; and means for engaging the brackets to fix the angular orientations of the brackets relative to the sidewalls.

6. The system of claim 5 wherein the bracket includes a portion having an opening therein with a plurality of notches being formed in an edge of the opening and wherein a stud extends from the corresponding sidewall for selective engagement in the slots.

7. The system of claim 1 further including means for mounting the bin to a wall having a plurality of horizontal slots formed therein.

8. The system of claim 7 wherein the mounting means includes a bracket having a pair of retainers extending therefrom, one retainer being formed to rest upon a shoulder formed adjacent one of the wall slots to support the weight of the bin, the other retainer being formed to engage an edge of another slot to retain the bin against rotation relative to the wall.

9. The system of claim 1 wherein the front panel is transparent and free of obstruction to provide an unrestricted view into the tray.

* * * * *